United States Patent [19]

Viola et al.

[11] 4,424,500

[45] Jan. 3, 1984

[54] BEAM FORMING NETWORK FOR A MULTIBEAM ANTENNA

[75] Inventors: Raymond D. Viola, Oyster Bay; Gerard L. Hanley, Melville, both of N.Y.

[73] Assignee: Sperry Corporation, New York, N.Y.

[21] Appl. No.: 220,228

[22] Filed: Dec. 29, 1980

[51] Int. Cl.[3] ..... H01P 3/08; H01P 5/12

[52] U.S. Cl. ..... 333/128; 333/26; 333/33; 333/246; 343/373

[58] Field of Search ... 343/100 SA, 854, 700 MS File; 333/116, 128, 26, 33, 246

[56] References Cited

U.S. PATENT DOCUMENTS 4,088,970 5/1978 Fassett et al. ..... 343/854

4,231,040 10/1980 Walker ..... 343/854

*Primary Examiner*—Theodore M Blum

*Attorney, Agent, or Firm*—Howard P. Terry; Seymour Levine

[57] ABSTRACT

A beam forming network comprising multi-deck circuitry with a plurality of levels within each deck formed by asymmetric striplines having a multiplicity of inner conductor levels. Interlevel coupling is accomplished with 3 dB couplers which power split signals incident thereto between transmission line levels and 0 dB interlevel couplers which transfer signals from one level to another without significant attenuation.

7 Claims, 26 Drawing Figures

BEAM FORMING NETWORK FOR A MULTIBEAM ANTENNA

BACKGROUND OF THE INVENTION

1. Field of the Invention

The invention pertains to feed networks for array antennas and more particularly to beam forming networks to feed array antennas in a manner to establish multiple independent radiated beams.

2. Description of the Prior Art

An array of antenna elements may provide simultaneous multiple beams with the utilizaton of a beam forming network that couples each input port of a multiplicity of input ports to all the elements in the atennan array. A signal at an input port is coupled through the network to all the array elements to establish an aperture distribution to radiate a beam in a direction associated with that input port. One such beam forming network, generally known as a Butler matrix, performs this coupling losslessly with a minimum number of directional couplers and fixed phase shifters. This network, however, requires a large number of transmission line crossovers within the network in order to establish the proper aperture distribution for each beam in space. When stripline is utilized in the transmission line for the network, these crossovers are accomplished with multideck stripline circuits and interdeck connections. These interdeck connections are generally accomplished by positioning connecting metal pins between the decks on which the striplines to be connected are located and soldering the striplines to these interdeck connecting pins. For many applications this type of construction establishes amplitude and phase distributions across the aperture within tolerance limits that provide acceptable free space antenna patterns. In applications, however, wherein low antenna side lobe levels are required, the random phase shifts and junction losses realized through the multiplicity of interdeck connections make it difficult to maintain the necessary aperture phase and amplitude distribution tolerance limits. Though low antenna side lobes may be realized with this type of construction, their achievement is difficult and costly.

SUMMARY OF THE INVENTION

A beam forming network for a multi-beam antenna constructed in accordance with the principles of the present invention includes a power divider for coupling each of n co-planar input ports through at least two nonplanar output ports which in turn are coupled to corresponding input ports of a multi-decked beam forming matrix. Each deck of the beam forming matrix is multi-levelled and is constructed with stripline circuitry to form a Butler matrix. Line crossovers inherent to the Butler construction are accomplished with circuit elements that couple signals between levels of a deck so that crossing lines are located at different levels. These elements eliminate the necessity for utilizing pin level transitions to avoid the intersection of crossing lines at equal levels. The output terminals of the Butler matrix, which are at two different levels for a two deck Butler matrix construction, are coupled to an element level transformer which provides a transition from this multilevel array of terminals to an array of co-planar antenna elements.

DESCRIPTION OF THE PREFERRED EMBODIMENTS

Figures 1, 9A:
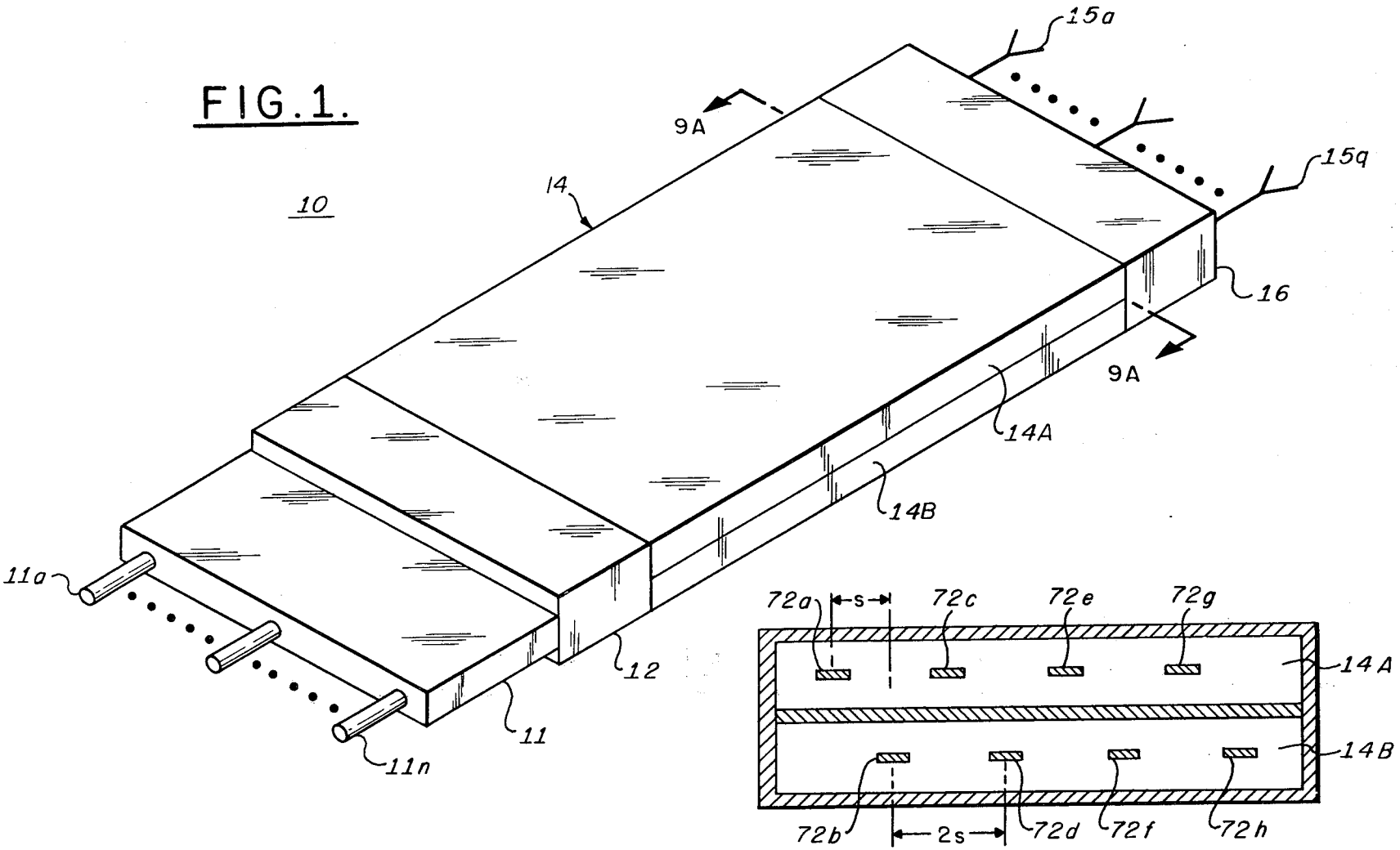
FIG. 1 is a representation, partially in isometric view, of the assembled major components of an antenna system which utilizes the principles of the present invention.
FIG. 9A is a cross-sectional view of FIG. 1 looking towards the Butler matrix at its junction with the Element Level Transformer.

Referring to FIG. 1, a multibeam antenna system 10 incorporating the principles of the present invention includes a power divider 11 which couples signals incident to each of the input terminals **11*a* through 11*n* to at least two input terminals of a deck level transformer 12, such as that described in our corresponding U.S. patent application Ser. No. 220,226. Each of the input terminals of deck level transformer 12 is coupled to a designated inner conductor of a symmetrical stripline system on a preselected deck of at least two decks of stripline circuitry forming Butler matrix 14. The inner conductors of each of the at least two decks of stripline circuitry are converted to asymmetrical striplines by means of symmetric-asymmetric stripline transformers contained in decks 14A and 14B of Butler matrix 14, wherefrom they are coupled to the circuitry on designated levels comprising the Butler matrix 14. The outputs ports of each deck of the Butler matrix are in symmetric stripline and are uniformly distributed in the central planes of each deck. These output ports are transformed to a common level and appropriately coupled to co-planar antenna elements 15*a* through 15*q* by element level transformer 16**.

Figure 2:
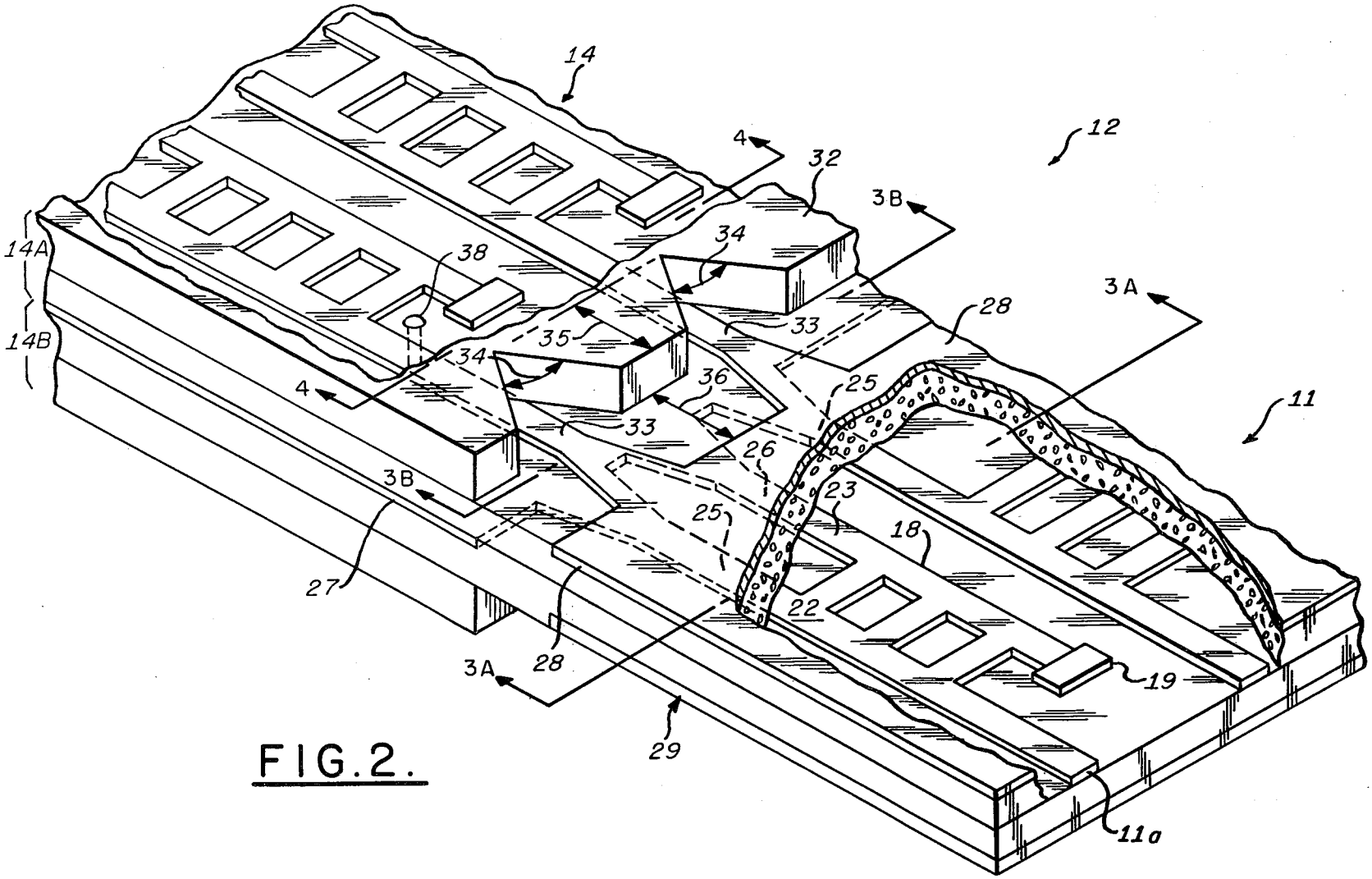
FIG. 2 is an illustration of the deck level transformer referenced in FIG. 1.

Coupling each input port 11*a* through 11*n* to the two decks of the Butler matrix 14A and 14B of the Butler matrix 14 may be accomplished through the power divider 11, yet to be described, and the deck level coupler 12 shown in FIG. 2. An input port, as for example port 11*a*, is coupled to one arm of a three branch 3 dB stripline coupler 18, the adjacent arm of which is coupled to a matched termination 19 while the output ports 22 and 23 are coupled to the input striplines 25 and 26 of the deck level coupler 12. Deck level coupler 12 may be constructed by transforming the input striplines 25 and 26 to the common ground plane 27 of the decks 14A and 14B and converting the upper 28 and lower 29 ground planes at the input end of the deck level coupler 12 to the center conductors of the upper deck 14A and lower deck 14B respectively.

Figure 3A:
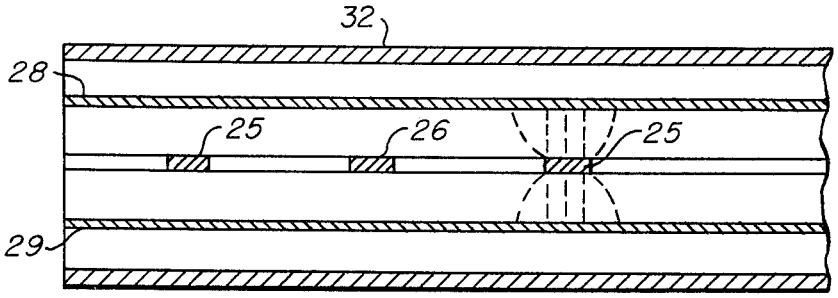
FIGS. 3A, 3B and 4 are cross-sectional views taken through selected sections of the deck level transformer of FIG. 2.
Figure 3B:
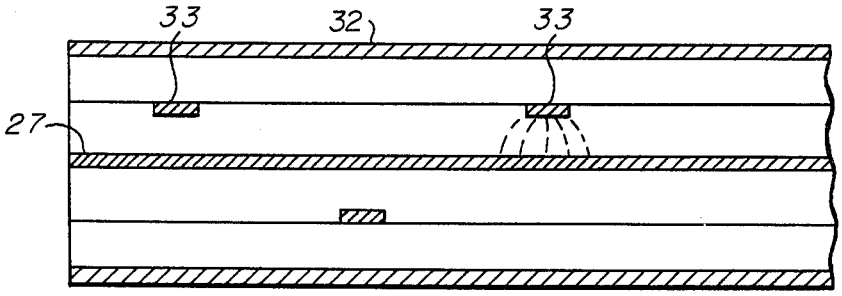
Figure 4:
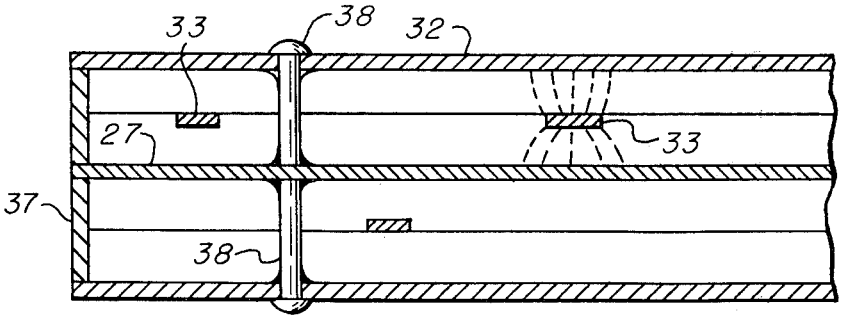

Commencing with the multi-deck section of the deck level coupler 12, the upper ground plane 32 is gradually removed in the vicinity of the stripline conductors 33 with a taper angle 34 which extends a distance 35 from the apex after which the ground plane is completely removed establishing a microstrip circuit over this distance for the center conductors 33. The center conductors 33 are broadened using a broadening angle similar to the angle 34 for a distance 36 after which all center conductors 33 merge with the ground plane 28 of the symmetrical stripline section of the deck level coupler 12 which couples to the power divider 11. Over the distance 36, the center strips 25 of the symmetrical stripline section are similarly tapered to merge with the common ground plane 27 between the upper deck 14A and the lower deck 14B. This transition is shown in cross-section in FIGS. 3A, 3B, and FIG. 4. In a similar manner, the center strips 26 are merged with the common ground plane 27 and the center strips of the lower deck 14B are converted to the lower ground plane 29 of the symmetrical stripline section of the deck level coupler 12.

Figure 5:
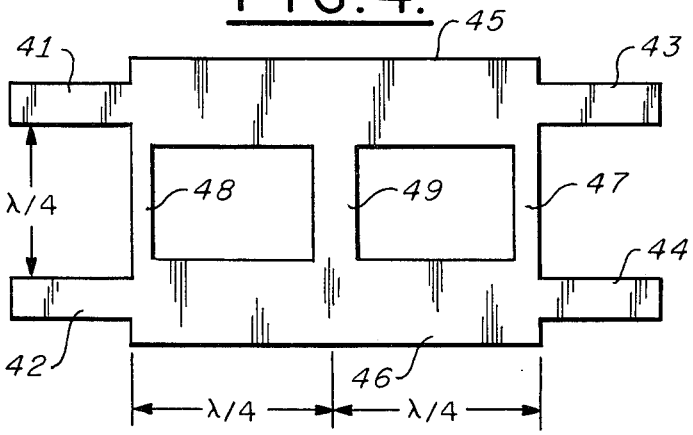
FIG. 5 is a plan view illustrating a 3 dB coupler useful in the apparatus of FIG. 1.

Each of the three branch 3 dB couplers may be designed by methods well known in the art, as for example the method described by Reed and Wheeler in the IRE Transactions on Microwave Theory and Techniques, Volume MTT-4, Number 4, October 1956. A coupler designed with this procedure to match a 50 ohm symmetrical stripline may take the form shown in FIG. 5 wherein the circuit coupling sections 41,42, 43 and 44 are each 50 ohms, the intercoupling sections 45,46 and the middle branch 49 are each 35.35 ohms and the branches 47 and 48 are each 120.77 ohms. These impedances provide maximum isolation and minimum coupling variation over a desired band. Over an 11% frequency band the isolation will be greater than 37 dB and the coupling variation will be less than 0.12 dB.

Figure 6:
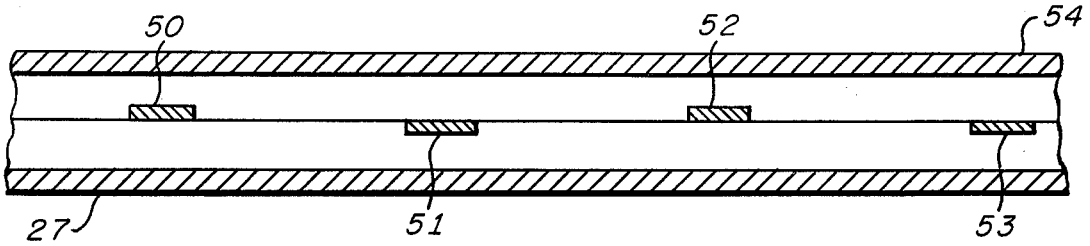
FIGS. 6 through 8 are plan and elevation views of an interlevel transformer useful in the apparatus of FIG. 1.
Figure 7:
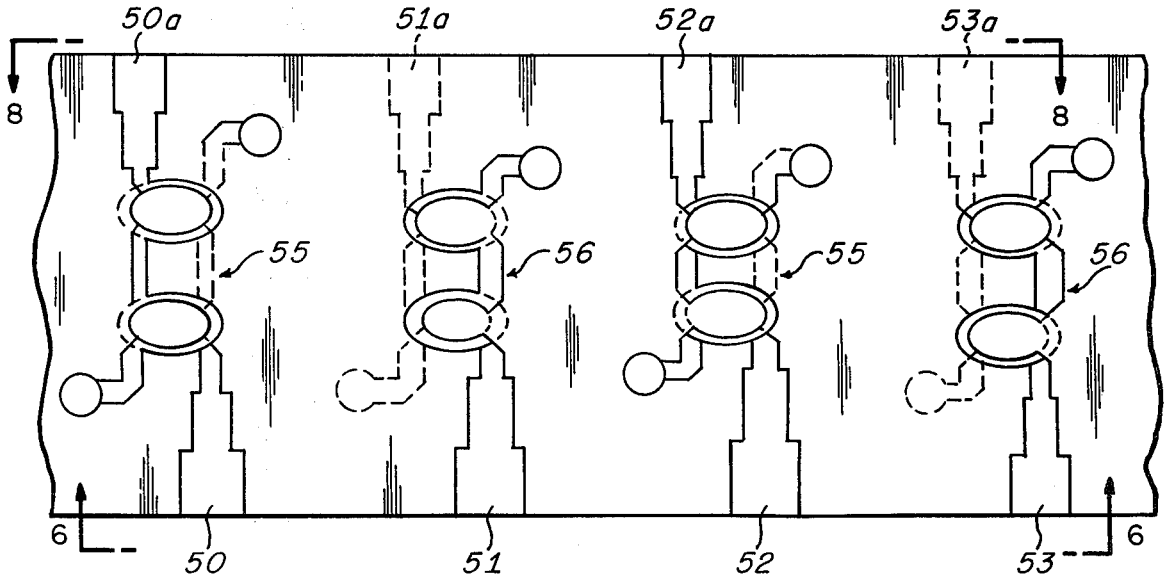
Figure 8:
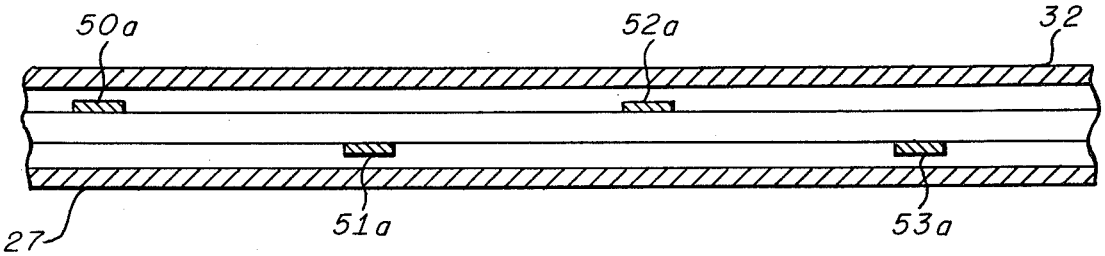

After the transition through the deck level coupler 12, the stripline in the Butler matrix 14 in each deck 14A and 14B will exhibit a symmetric configuration with the central strips substantially equidistant between the upper and lower ground planes as for example the positioning of the central strips 50,51,52 and 53 of the upper deck 14A positioned between the lower ground plane coinciding with the common ground plane 27 and the upper ground plane 54 as shown in FIG. 6. To eliminate costly interlevel pins within the Butler matrix and reduce the number of levels therein to two stripline etched surfaces, this symmetrical stripline is converted to asymmetrical stripline, shown in cross-section in FIG. 8, by the symmetric-asymmetric line transformer shown in FIG. 7. In FIG. 7, 0 dB interlevel couplers 55, yet to be described, transform the center conductors 50 and 52 to conductors 50*a* and 52*a*, respectively, at the upper level of the asymmetric line while 0 dB interlevel couplers 56 transform the center level conductors 51 and 53 to conductors 51*a* and 53*a*, respectively, at the lower level of the asymmetric line.

The invention will now be more fully described with reference to FIG. 9 which is a schematic diagram of a two beam eight antenna element Butler beam forming network with the elements arranged to be in conformity with the block diagram of FIG. 1. Though the $2\times8$ will be described, it will be apparent to those skilled in the art that the principles to be discussed are not limited thereto, and that these principles are applicable to any $m\times n$ system.

A signal incident to input port 61 is coupled to a three branch 3 dB coupler 62 of power divider 11 and therethrough to output transmission lines 62*a* and 62*b* with equal amplitude and in-phase quadrature. Throughout this discussion, the convention will be used that the phase shift straight through the directional coupler, such as from input port 61 to output line 62*b*, is 90 degrees while the phase shift in the coupled arm, such as from input port 61 to output transmission line 62*a*, is 0 degrees. Output transmission lines 62*a*, 62*b* are coupled to the deck level transformer 12, which may be of the type described in U.S. patent application Ser. No. 220,226, and therefrom respectively to decks 14A and 14B. Transmission line 62*a* is coupled in deck 14A through a $67\frac{1}{2}°$ phase shifter 63, which may be of the Schiffman type well known in the art, to an input transmission line 64*a* of a three branch 3 dB coupler 64, constructed in symmetrical stripline, for which a second input port 64*b* is coupled to a matched termination 64*c*. The output transmission lines 64*d* and 64*e* of the 3 dB coupler 64 are coupled through a symmetric-asymmetric line transformer 65, yet to be described, to transmission lines 65*d* and 65*e*, respectively, on the upper inner conductor of a two level asymmetric strip transmission line. Transmission line 65*d* is coupled at this level through a 45 degree phase shifter 66 to the input transmission line 67*a* of an interlevel 3 dB coupler 67, yet to be described, via transmission line 68. As will be apparent, the inner conductors of transmission lines 65*d* and 65*e* traverse regions wherein crossings by inner conductors on the lower level occur. To provide substantially complete decoupling between the transmission lines associated with the crossing inner conductors, a conversion from full height asymmetric stripline to half height asymmetric stripline is accomplished in the region 69. This conversion will be explained subsequently with the aid of FIGS. 15 through 20.

Interlevel 3 dB coupler 67 is a four port device, in full height asymmetric stripline, having an input transmission line 67*a* and an output transmission line 67*b* at a common level, as for example, the upper level of a two inner level asymmetric transmission line and an input transmission line 67*c* and an output transmission line 67*d* at a different level, as for example, the lower level of a two level asymmetric stripline. The coupling between an input transmission line and the two output transmission lines is 3 dB with the signal in the common level output transmission line in-phase with the incident signal and the signal in the non-common level output transmission line in quadrature with the input signal. The output transmission lines 67*b* and 67*d* of interlevel coupler 67 are coupled to asymmetric-symmetric stripline transformer 70 wherein the transmission lines are converted to half height asymmetric stripline and coupled therefrom to a common level.

The output transmission lines 65*e* from the symmetric-asymmetric transformer 65 at the upper level of the two level asymmetric transmission line is coupled via input transmission line 71*a* of interlevel 3 dB coupler 71 to a common level output transmission line 71*b* and to a lower level output transmission line 71*d* which in turn are coupled to asymmetric-symmetric transformer 70 wherein they are transformed to a common level. These common level transmission lines 67*b'*, 71*b'*, 67*d'* and 71*d'* are respectively coupled through element level transformer 16 to antenna elements 72*a*, 72*c*, 72*e* and 72*g*.

Output transmission line 62*b* of symmetric stripline 3 dB coupler 62 is coupled via input transmission line 74*a* to a symmetric stripline 3 dB coupler 74 in the lower deck 14B, the output ports 74*b* and 74*c* of which are coupled via symmetric-asymmetric stripline transformer 75 to the upper and lower levels of a two level asymmetric stripline of the lower deck 14B. Transmission line 75*d* at the upper level of the asymmetric stripline is coupled to output transmission line 74*b* and is further coupled through a 45° phase shifter 76 to an interlevel 3 dB coupler 77, while output transmission line 75*e*, at the upper level of the asymmetric strip transmission line, is coupled to output transmission line 74*c* is further coupled via input transmission line 81*a* to interlevel 3 dB coupler 81. The output port 77*b* of coupler 77 and the output port 81*b* of coupler 81 are at the upper level of the two level asymmetric stripline while the output ports 77*d* and 81*d* are at the lower level. These output ports are coupled to an asymmetric-symmetric stripline transformer 80 wherein they are transformed to a common level as the center conductors of a symmetric transmission line. The output symmetrical transmission lines 77*b'*, 81*b'*, 77*d'* and 81*d'* respectively couple the output transmission lines 77*b*, 81*b*, 77*d*, and 81*d*, through element transformer 16 to elements 72*b*, 72*d*, 72*f*, and 72*h*. To facilitate the element level transformation, to be described subsequently, the arrangement of the transmission line in the upper deck 14A and lower deck 14B at the output end of the respective asymmetrical-symmetrical transformers 70 and 80 is as shown in FIG. 9A. The spacing between the inner conducting elements at each level is twice the desired element spacing s while the spacing between an inner conductor in deck 14A and an inner conductor in deck 14B is substantially equal to the desired element spacing of the array 72.

Figure 9:
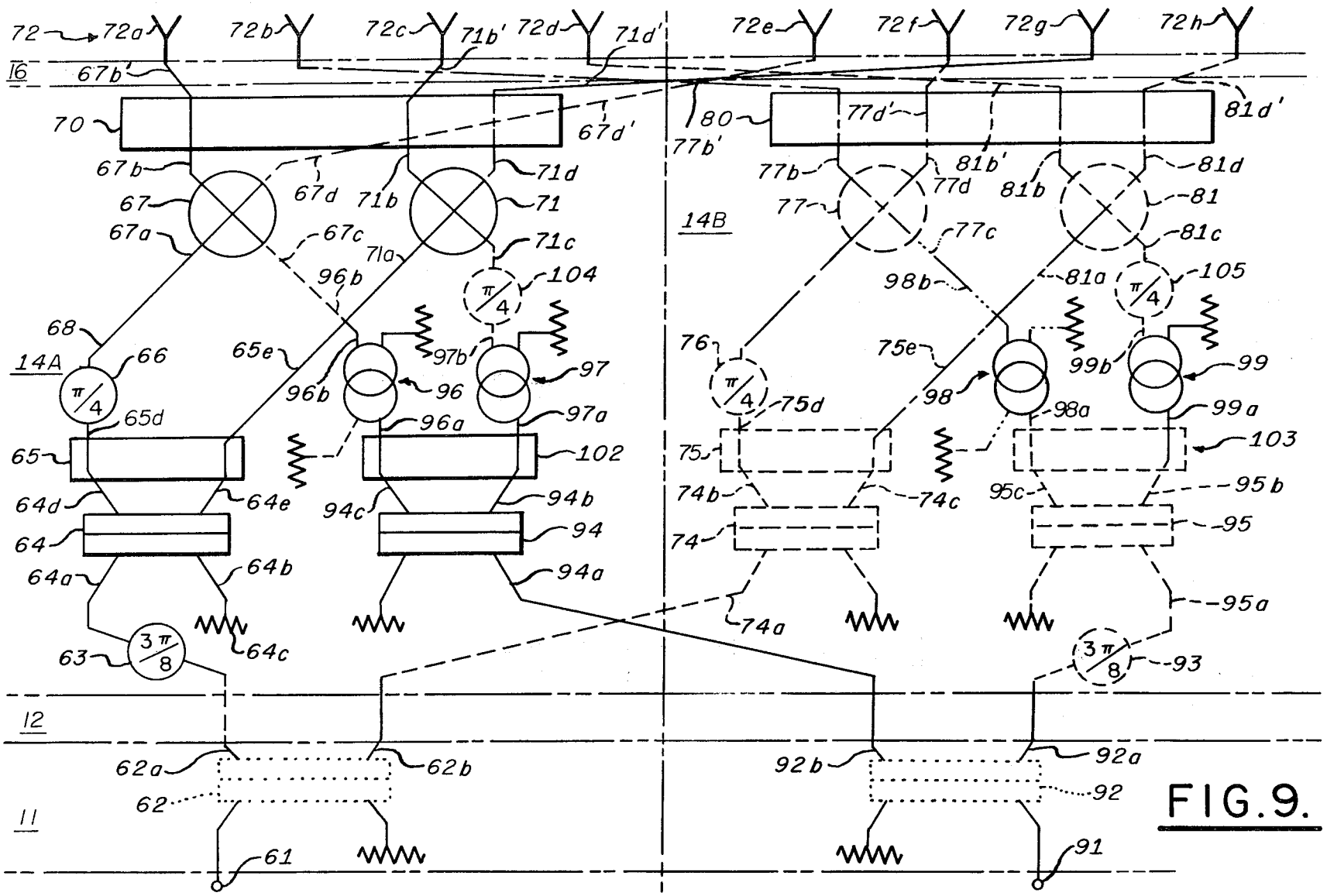
FIG. 9 is a schematic diagram of a two beam eight element array utilizing the principles of the present invention.

It will be recognized by those skilled in the art that a signal coupled to input terminal 61 will traverse the circuitry of FIG. 9 and provide a phase gradient across the array of elements 72*a* through 72*h* that is equal to $\pi/8$. A negative phase gradient of equal magnitude is realized when a signal is coupled to the second input port 91. This signal will be coupled to a symmetric stripline 3 dB coupler 92, and via output transmission line 92*a* to a $67\frac{1}{2}°$ phase shifter 93 in the lower deck 14B via the deck level coupler 12. Simultaneously, a signal of equal amplitude as the signal coupled to a phase shifter 93 but in-phase quadrature therewith is coupled from the output transmission line 92*b* via the deck level coupler 12 to the input transmission line 94*a* of a symmetrical stripline 3 dB coupler 94 in the upper deck 14A. In deck 14B, a phase shifted signal from phase shifter 93 is coupled to an input port 95*a* of a symmetrical stripline 3 dB coupler 95. The output transmission lines 94*c* and 94*b* of 3 dB coupler 94 in deck 14A and 95*c* and 95*b* of 3 dB coupler 95 in deck 14B are respectively coupled to upper level input transmission lines 96*a*, 97*a*, 98*a* and 99*a* of 0 dB interlevel couplers 96, 97, 98 and 99 via symmetric-asymmetric transformers 102 and 103. These 0 dB couplers will couple a signal incident thereto at one level of an asymmetrical stripline, as for example transmission line 96*a* at the upper level of deck 14A, to a transmission line at a second level of an asymmetrical stripline, as for example transmission line 96*b*, with substantially zero attenuation and a phase shift in the order of 90 degrees. Thus, transmission line 96*a* is coupled to the input transmission line 67*c* of interlevel 3 dB coupler 67 via output transmission line 96*b*, accomplishing a level change without the utilization of interlevel pins and soldered connections. Similarly, transmission line 98*a* is coupled via transmission line 98*b* to the input transmission line 77*c* of 3 dB interlevel coupler 77 in deck 14B and transmission lines 97*a* and 99*a* in the upper level of deck 14A and deck 14B, respectively, are coupled via 0 dB interlevel couplers 97, 99, transmission lines 97*b*, 99*b*, and 45 degree phase shifters 104, 105 to the input transmission lines 71*c*, 81*c* of 3 dB interlevel couplers 71 and 81 on decks 14A and 14B, respectively. Signals coupled to input transmission lines 67*c*, 71*c*, 77*c* and 81*c* are coupled through interlevel 3 dB couplers 67, 71, 77 and 81, asymmetric-symmetric strip transmission line transformers 70 and 80 and element level transformer 16 to the array elements 72*a* through 72*h*.

Figure 10:
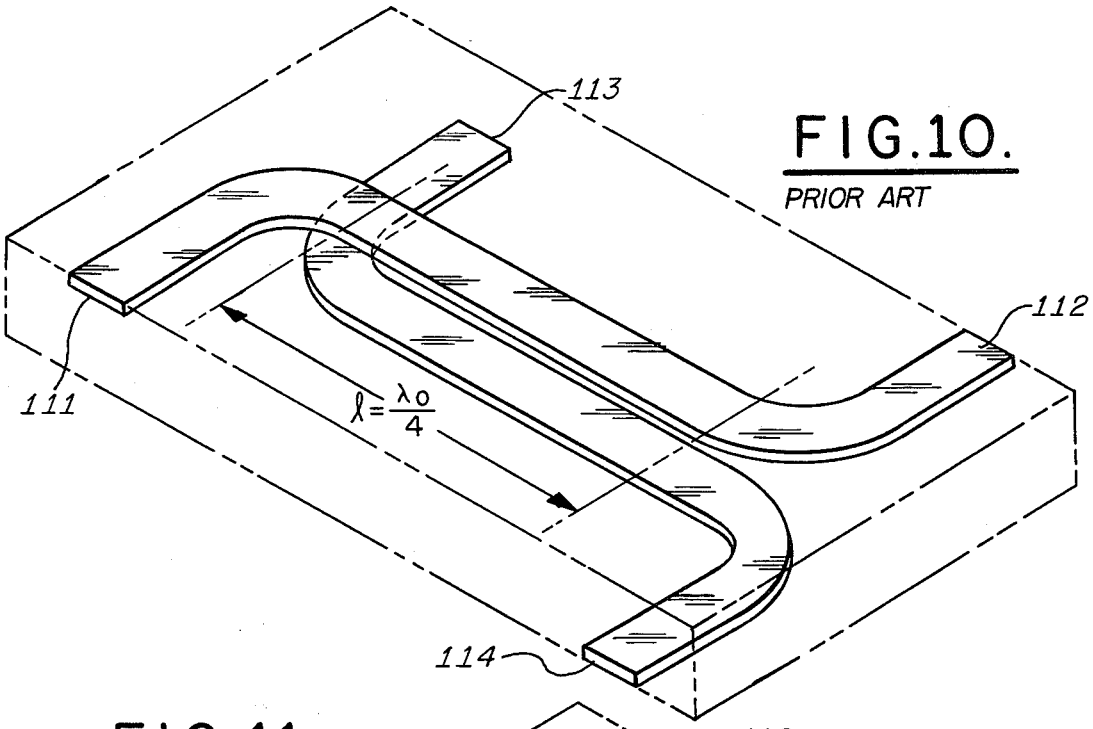
FIG.10. PRIOR ART
FIG. 10 is a perspective view of the inner conductors of an interlevel directional coupler.
Figure 11:
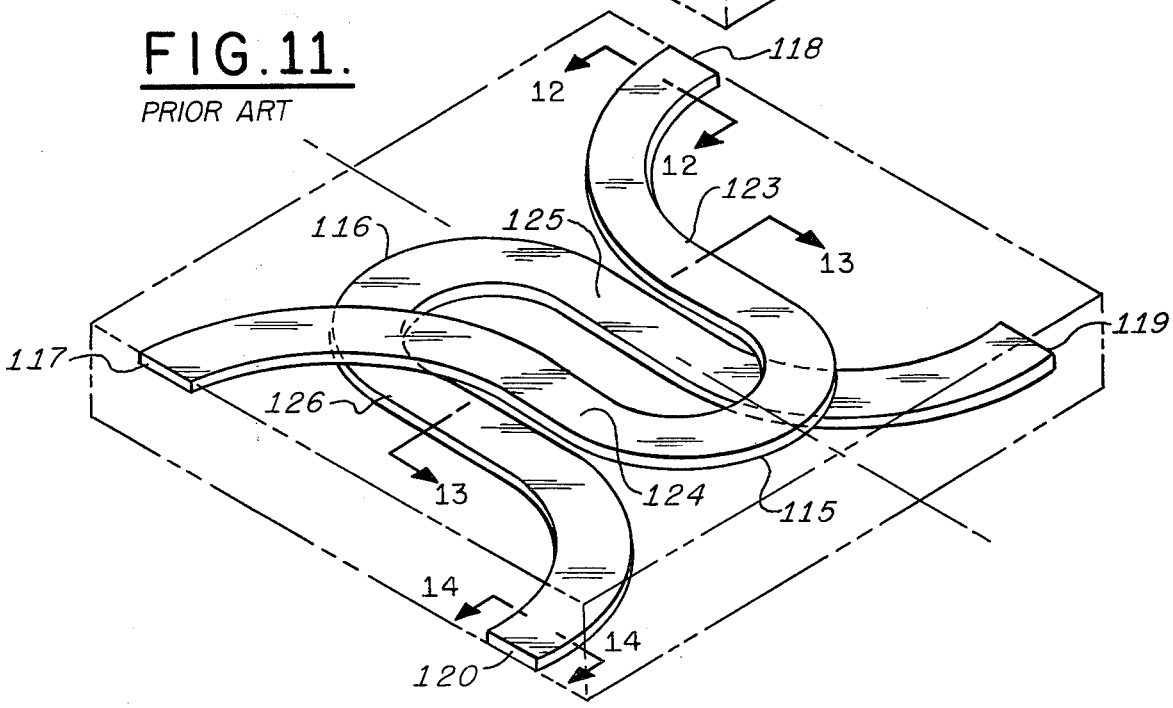
FIG.11. PRIOR ART
FIG. 11 is a perspective view of the inner conductors of a 3 dB interlevel coupler.
Figure 12:
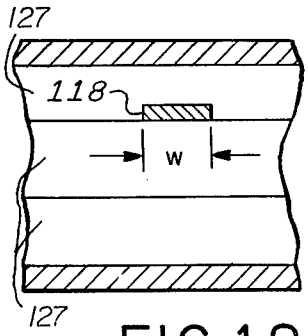
FIGS. 12 through 14 are cross-sectional views of selected sections of FIG. 11.
Figure 13:
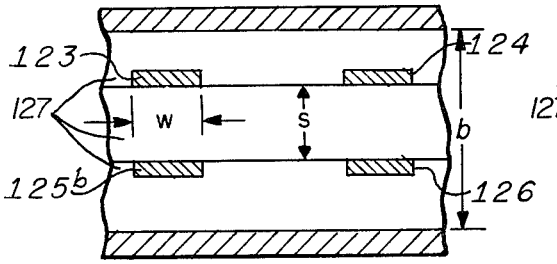
Figure 14:
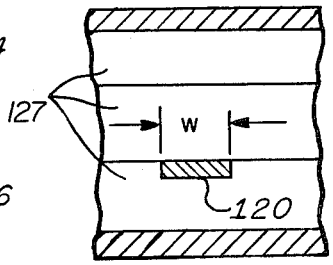

Interlevel 3 dB couplers 67, 71, 77 and 81 may include two 8.3 dB stripline couplers of the type described by Gunderson and Guida in the Microwave Journal, Volume 8, Number 6, June 1965. A diagram of the inner conductors of this type coupler is shown in FIG. 10. This type coupler will couple a signal incident to the input transmission line 111 at one level of a two inner level stripline configuration to a common level output transmission line 112 and to a lower level output transmission line 113 with substantially no coupling to the forward direction lower level output transmission line 114. When a signal with a voltage $V_o$ is incident to transmission line 111 at a frequency for which the coupling length $l=\lambda/4$, this type of coupler, designed for $-8.3$ dB coupling between transmission lines 111 and 113, will couple a signal to transmission line 113 that is $0.385\ V_o$ and a signal to transmission line 112 that is $0.923\ V_o$ with a phase angle that is $-90°$ from that of the signal at transmission line 113. When two such couplers are placed in tandem as shown in FIG. 11 and the length of the interconnecting transmission lines 115 and 116 are properly chosen, a 3 dB coupler is realized between input transmission line 117 and output transmission lines 118 and 119 with the signal phase of the output transmission line 119 in quadrature with the signal phase of transmission lines 117 and 118. Substantially no signal is coupled to transmission line 120. In FIGS. 12, 13, and 14 are cross-sectional views taken through three sections of 3 dB interlevel coupler of FIG. 11, FIG. 12 representing the upper level output strip transmission line, FIG. 13 representing the strip lines in the coupling region, and FIG. 14 representing the lower level output strip transmission line. When the material 127 is used for spacing the inner and outer conductors is constructed of a foam dielectric with a dielectric constant substantially equal to 1.03 and the spacings between the upper level inner conductor and the upper ground plane is equal to the spacing between the lower level inner conductor and the lower level ground plane, a 50 ohm system may be realized when the spacing between the two inner conductors s, the spacing between the two ground planes b, and the width of the inner conductors w are in the relationships s/b=0.366 and w/b=1.4.

Figure 15:
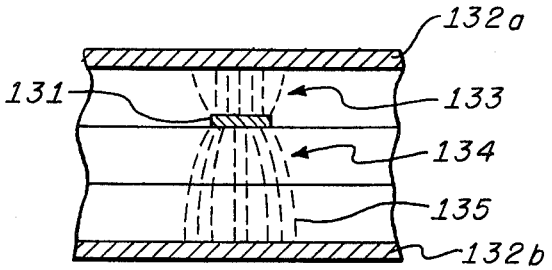
FIGS. 15–18 are cross-sectional views depicting transitions from full height asymmetrical striplines to half height asymmetrical striplines with electrical field lines between the inner conductor and ground indicated thereon.
Figure 16:
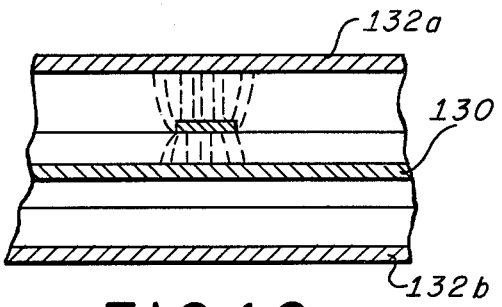
Figure 17:
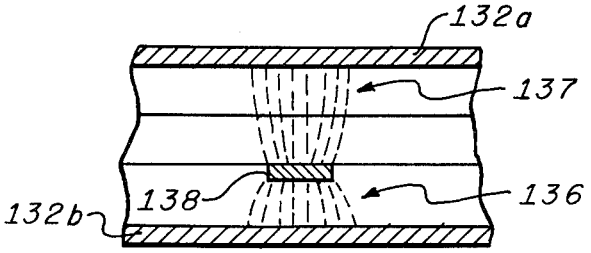
Figure 18:
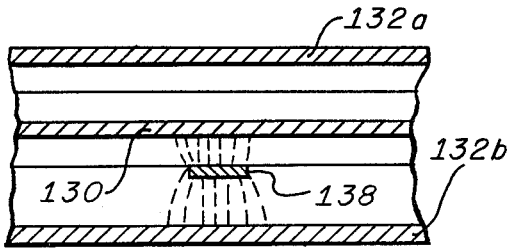
Figure 19:
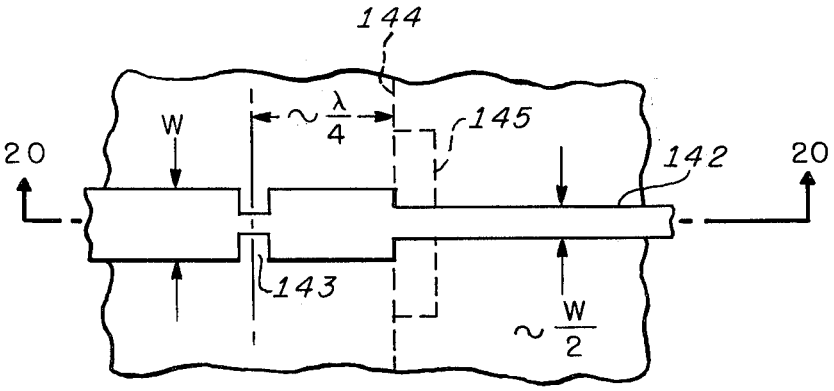
FIG. 19 is a plan view of a matching network useful for matching a full size asymmetric stripline to a half size asymmetric stripline.
Figure 20:
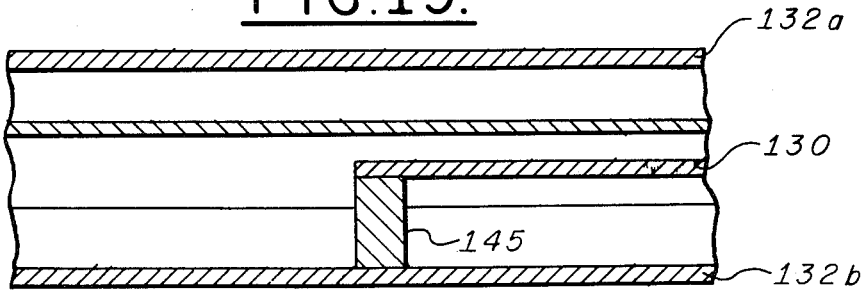
FIG. 20 is a cross-sectional view of the matching network of FIG. 19.

As stated previously, the desired characteristic of the interlevel 3 dB coupler is the positioning of the output ports at different stripline levels thus allowing lines to cross with minimum coupling therebetween and eliminating all interlevel pin connections normally associated with Butler matrices. To provide complete decoupling between crossing lines, the asymmetrical striplines may be converted to half height asymmetrical striplines by inserting a metallic sheet 130 at the midplane between the ground planes 132*a* and 132*b* as shown in FIGS. 16 and 18 in regions external to the coupling region of FIG. 11. Referring to FIG. 15, an upper level asymmetrical stripline with an inner conductor 131, which corresponds to the upper level strip transmission line 118 of FIG. 12 when excited will establish the field lines 133 and 134 between the ground planes 132*a* and 132*b*, respectively. These field lines form an angle of 90 degrees with all metallic surfaces, as for example, the field line 135 with the ground plane 132*b*. If a metallic surface is inserted at a plane to which the field lines are perpendicular, the over-all system would be unaltered. The insertion of metallic sheets at the mid-plane to which the field lines are not perpendicular, alters the characteristic impedance of the line and generates higher order modes. A similar situation exists with the lower level stripline in FIGS. 17 and 18. The field lines 136 and 137 created between the asymmetric inner conductor 138 and the ground planes 132*b* and 132*a*, respectively, are disturbed when the metallic sheet 130 is inserted mid-way between the ground planes 132*a* and 131*b*. Thus, the transformation from full size asymmetric stripline to half size asymmetric stripline requires impedance matching and mode suppression. This may be accomplished as shown in FIG. 19 by reducing the inner strip 142 in the half size stripline to be approximately half the width of the inner strip in the full size stripline and providing a reactance 143, shown as an inductance in FIG. 19, approximately a quarter wavelength from the junction 144 between the full size and half height asymmetric striplines. To prevent the parallel plate mode from propagating between the asserted metallic ground plane and an original ground plane, as for example, between the ground planes 130 and 132*b* in FIG. 20, a metallic block 145 which makes good electrical contact with the ground planes 130 and 132*b* is inserted in the half height asymmetrical stripline with one edge substantially coincident with the junction 144.

Figure 21:
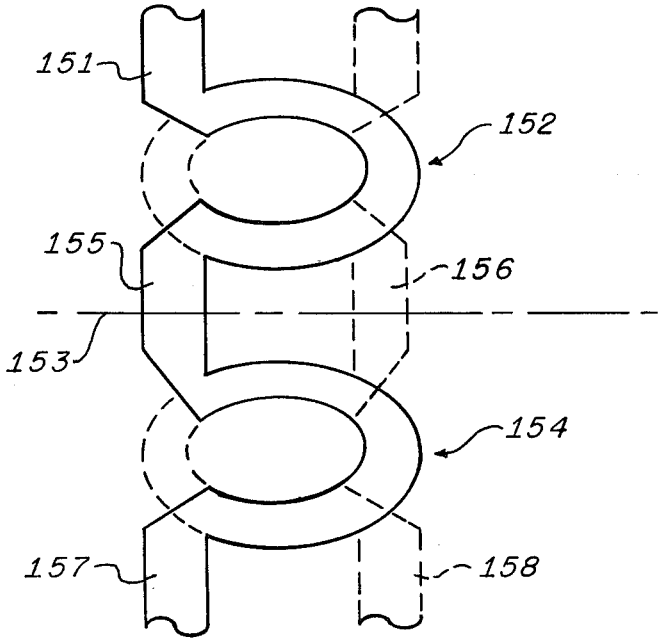
FIG. 21 shows interlevel couplers.

To accomplish a 0 dB level change, the 0 dB interlevel coupler may be designed as two interlevel 3 dB couplers, previously described, as shown in FIG. 21. In this arrangement, a signal with amplitude of $V_o$ coupled to an input transmission line 151 of the first 3 dB interlevel coupler 152 will couple at the junction 153 to the second 3 dB interlevel coupler 154 as a signal with an amplitude of 0.707 $V_o$ in the co-planar output transmission line 155 and as a signal with an amplitude of 0.707 $V_o$ at a phase angle of −90 degrees in the non-planar output transmission line 156. The signal in the co-planar output transmission line 155 couples across the junction 153 via interlevel 3 dB coupler 154 as a signal with an amplitude of 0.5 $V_o$ at a phase angle of 0 degree to the co-planar transmission line 157 and as a signal with an amplitude of 0.5 $V_o$ at a phase angle of −90 degrees to the non-co-planar output transmission line 158. Similarly, the signal in the non-planar output transmission line 156 of interlevel 3 dB coupler 152 couples across the junction 153 via interlevel 3 dB coupler 154 to couple a signal with an amplitude of 0.5 $V_o$ at a phase angle of −180 degrees to co-planar output transmission line 157 and a signal with an amplitude of 0.5 $V_o$ at a phase angle of −90 degrees to non-co-planar output transmission line 158. Thus, the signals at the co-planar output transmission line 157 cancel while a signal with an amplitude of $V_o$ and a phase angle of −90 degrees is coupled to non-planar output transmission line 158 of 3 dB interlevel coupler 154. As previously discussed, this type of 0 dB interlevel coupler may be employed as an interlevel transformer, asymmetric to symmetric line transformer, and deck level transformer.

Figure 22:
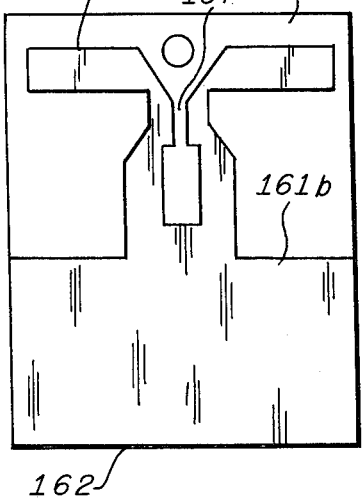
FIGS. 22 through 24 are top, side and bottom views of the Element Level Transformer referenced in FIG. 1.
Figure 23:
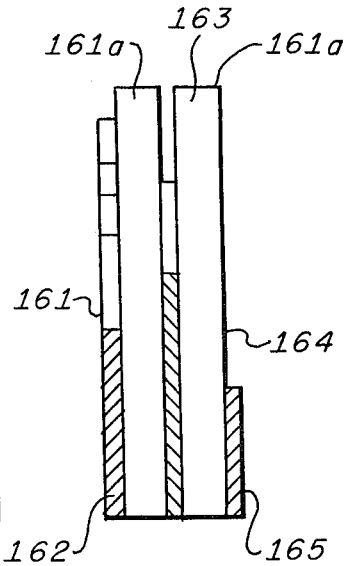
Figure 24:
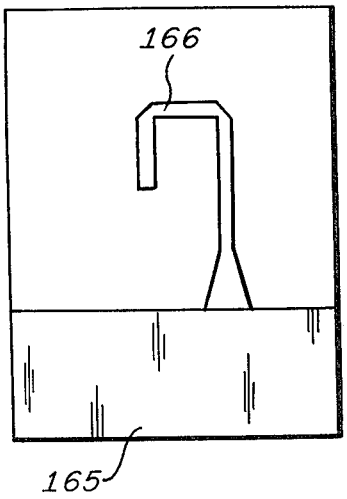

For proper operation, the antenna elements 72*a* through 72*h* of FIG. 9 must lie in a common plane. As shown in FIG. 9A, the output transmission lines of Butler matrix 14 are in two planes, one centered in the upper deck level 14A, the second centered in the lower deck level 14B. By means of the element level transformer 16, these elements may be positioned in a common plane, which may be the common ground plane between the upper deck 14A and the lower deck 14B. This element level transformation may be accomplished by providing an array of dipole antenna elements 161 in FIG. 22 which emerge from the common ground plane 162. This type of element is well known in the art and has been described by J. E. Boyns and R. Grannini, et al each at the Array Antenna Conference NELC, San Diego, Calif. in February 1972. Coupling to this dipole may be accomplished by eliminating the lower ground plane for the lower deck 14B or the upper ground plane for the upper deck 14A for a distance from the edge 161*a* of the array to at least beyond the base 161*b* of the dipole element configuration, thus providing a dielectric 163 with an unclad region 164 and a copper clad region 165, as shown in FIG. 23. The center conductors of the deck output transmission lines are etched to form a loop 166 which is a printed circuit balum, such as that described by Bawer et al, in IRE Transactions on Microwave Theory and Techniques, Volume MTT-8, No. 3, May 1960. This balum positioned across the narrow gap 167 for coupling to the desired dipole. Thus the entire array is formed in the common ground plane between the upper and lower decks 14A and 14B, respectively, by etching an array of dipoles therein, alternately exciting these diipoles from each side by balums formed from the center stripline of the upper and lower decks and terminating the upper and lower ground planes of the decks 14A and 14B, respectively, at a desired distance from the edge of the array.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. An apparatus having a multiplicity of co-planar input ports numbering n and a plurality of co-planar output terminals numbering m wherein each of the n input ports are coupled to all of the m output terminals such that an excitation coupled to one of the input ports causes responsive excitation at each output terminal in a manner to establish a phase and amplitude distribution across the m output terminals that is associated with the excited input port comprising:

a power divider arranged to couple each of said n input ports to at least two non-planar output ports; and a matrix having input ports on at least two decks each coupled to one of said power divider output ports and output ports coupled to said m output terminals, each deck having sections thereof which include conductors on at least two levels with crossing conductors located at different levels and wherein transitions between levels are accomplished through non-contacting interlevel elements positioned in an electromagnetic coupling relationship.

2. An apparatus in accordance with claim 1 interlevel coupling elements include interlevel power dividers each having a section on a first level electromagnetically coupled to a section on a second level, said first section having first and second ports and said second section having third and fourth ports, said interlevel power dividers constructed and arranged to divide a signal incident to said first port between said second and third ports with said fourth port substantially decoupled from said first port.

3. An apparatus in accordance with claim 2 wherein said interlevel coupling elements include interlevel couplers, each having a first section on a first level in non-contacting electromagnetically coupling relationship with a second section on a second level, said first section having first and second ports and said section having third and fourth ports, each interlevel coupler constructed and arranged to couple signals between said first and third ports with said first and third ports substantially decoupled from said second and fourth ports.

4. An apparatus in accordance with claims 1, 2, or 3 wherein said matrix includes sections comprising first and second ground planes having three sections therebetween, a middle section and two outer sections, a first level determined by a plane at a boundary between said middle section and one of said outer sections, a second level determined by a plane at a boundary between said middle section and an outer section other than said one, and two level asymmetrical striplines having inner conductors positioned at said first and second levels.

5. An apparatus in accordance with claim 4 wherein said matrix further includes half height asymmetric stripline formed in preselected locations by positioning a metallic sheet substantially equidistant between said first and second ground planes.

6. An apparatus in accordance with claim 5 wherein said matrix further includes metallic blocks positioned at preselected locations in electrical contact with said equidistant metallic sheet and one of said first and second ground planes for suppressing parallel plate modes.

7. An apparatus in accordance with claim 6 further including an array of co-planar antenna elements and element level transformers coupled between said matrix and said co-planar elements for transforming said conductors at said first and second levels to a common level for respectively coupling to said co-planar elements.

* * * * *